United States Patent [19]

Shanklin et al.

[11] 4,035,983

[45] July 19, 1977

[54] SMOOTH PRODUCT TRANSFER HIGHSPEED L-SEALER

[75] Inventors: F. Garrett Shanklin, Groton; Edward F. Hunt, Littleton, both of Mass.; Francis X. King, Jr., Nashua, N.H.

[73] Assignee: Shanklin Corporation, Ayer, Mass.

[21] Appl. No.: 617,306

[22] Filed: Sept. 29, 1975

[51] Int. Cl.[2] ..... B65B 9/06

[52] U.S. Cl. ..... 53/28; 53/76; 53/182 R

[58] Field of Search ..... 53/76, 182, 28

[56] References Cited

U.S. PATENT DOCUMENTS

| | | | |
|---|---|---|---|
| 3,302,369 | 2/1967 | Vinciguerra | 53/182 |
| 3,429,100 | 2/1969 | Zelnick et al. | 53/182 |
| 3,581,461 | 6/1971 | McDurmont | 53/182 |
| 3,583,888 | 6/1971 | Shanklin | 53/182 |

*Primary Examiner*—Travis S. McGehee
*Attorney, Agent, or Firm*—Charles E. Pfund

[57] ABSTRACT

An automatic L-sealer is arranged to pass product, including fragile items and loose piles of stacked paper, tiles or similar flat articles, through the machine without abrupt drops or changes in support level for the product to avoid breakage or upsetting of the pile. In the case of stacked loose flat articles an infeed conveyor deposits a package on an air table and an insertion arm progresses the package through the overwrap station to a sealing area where the L-seal completes and separates the overwrapped package. The sealing area includes a discharge conveyor pivoted at its discharge end and elevated at the end adjacent the air table to transfer the overwrapped package without an abrupt drop but is thereafter lowered during the sealing cycle to permit the seals to be made midway of the height of the package. The insertion arm retracts out of the path of package flow during its return stroke permitting infeeding of the next package to be initiated prior to the completion of the return stroke. Automatic controls are provided to coordinate the various operations including starting the infeed conveyor while the insertion arm is returning to its starting position.

8 Claims, 15 Drawing Figures

SMOOTH PRODUCT TRANSFER HIGHSPEED L-SEALER

BACKGROUND OF THE INVENTION

This invention relates to the art of packaging machinery and more particularly to that class of overwrapping machine known generally as L-sealers and particularly to the type of in-line L-sealer disclosed in Shanklin U.S. Pat. No. 3,583,888.

There are certain types of packages which can be overwrapped readily in manual and semi-automatic machines which are not suitable for use in the existing types of automatic L-sealers. These include, for example, reams of paper, stacks of books, stacks of carpet tile, boxed cakes and other bakery products, trays of cookies and the like. The reason for this is several-fold.

One is that to obtain good performance during the shrinking step and a good appearance in the final overwrap wrapped and shrunk package it is desirable that the seal approximately intersect the fold line in the pre-folded film and that the combined fold and seal line about the package be approximately at the mid-point of the height of the package. In practice this means that in the conventional L-sealer the level of the base of the sealing area on which the package rests during the sealing operation be below the level of the tray in the package insertion area by approximately one-half of the height of the package.

Secondly, in existing in-line automatic L-sealers, the package is advanced across the package insertion area by means of a reciprocating pusher arm which requires that the infeed conveyor or station be elevated above the insertion tray by a distance at least equal to the height of the pusher arm so that the package may pass over the pusher arm on being advanced from the infeed station to the insertion station.

In addition, since the package insertion arm merely reciprocates the arm has to go through a full stroke and return to its initial position before the next package can be transferred from the infeed station to the insertion station. This means that the motion of the reciprocating arm while the package is being advanced must be relatively rapid and hence violent, if it is desired to operate an automatic L-sealer at a reasonable speed. In addition, since the infeed conveyor cannot be started to feed the next package during the return stroke of the insertion arm, the speed of the conveyor must be rapid resulting in violent starts and stops of the product. The combination of the sudden drops and the rapid motion of the reciprocating arm and infeed conveyor tend to make existing automatic L-sealers unsuitable for items which can be damaged or dislodged by sudden movement and shock such as those mentioned above.

SUMMARY OF THE PRESENT INVENTION

It is the purpose of this invention to provide an automatic L-sealer suitable for the packaging of delicate or dislodgable items such as reams of paper, stacks of books, stacks of carpet tile, boxed cakes, and other bakery products, trays of cookies and the like. It will be understood that the machine as described is designed for successful operation in these and other unusually difficult situations.

In accordance with the present invention an in-line L-sealer of the general configuration corresponding to the aforementioned Shanklin patent is conditioned for handling stacked articles and other difficult product by having a smooth, substantially uniform level flow path through the machine automatically operated to feed, advance and overwrap and complete the L-seal around the package with the various operations coordinated to obtain a substantially smooth transition between the infeed conveyor, the wrapping station and the sealing station followed by the discharge conveyor operation from which the package is discharged usually to a shrink tunnel. The various phases of the operation are coordinated such that each step is performed without distrupting the integrity or fragile nature of the product being wrapped and the infeed and product advance operations are coordinated such that high speed can be achieved by product advanced during the sealing operation. These and other features of the invention will be understood from the following detailed description taken in conjunction with the accompanying drawings.

DETAILED DESCRIPTION OF THE PREFERRED EMBODIMENT

Figure 1:
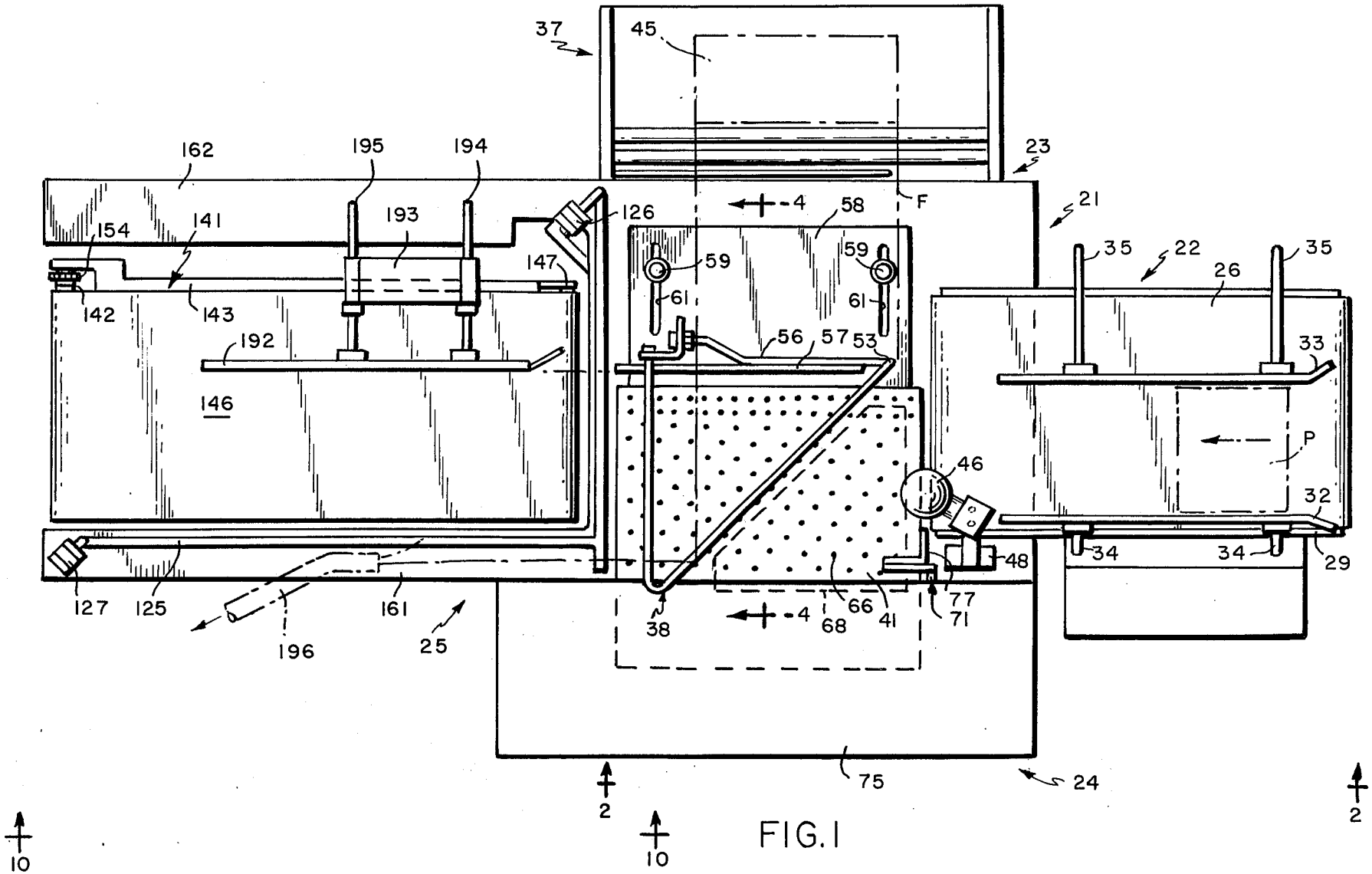
FIG. 1 is a plan view of the packaging apparatus of the present invention.

Referring to FIG. 1, the packaging apparatus of the present invention which is indicated generally at 21 comprises a package infeed section indicated generally at 22, a film unwind and inverting section indicated generally at 23, a package insert section indicated generally at 24 and a sealing section indicated generally at 25.

The package infeed section, indicated generally at 22, comprises a package infeed conveyor 26 mounted on two rollers 27 and 28 (shown in FIG. 2) which in turn are mounted on an extension 29 of main frame 31. A pair of parallel guides 32 and 33 associated with the upper surface of infeed conveyor 26 are provided to establish a fixed path of travel for items to be packaged (indicated at P) along conveyor 26. Guides 32 and 33 are mounted on U-shaped support arms indicated at 34 in the case of guide 32 and at 35 in the case of guide 33, which in turn are mounted in extension frame 29 in such manner as to permit the adjustment of guides 32 and 33 to the desired position relative to the front of conveyor 26. Conveyor 26 is approximately as wide as the maximum size package intended to be handled and guides 32 and 33 are mounted so as to be adjustable in or out to adjust for package width. It will be noted, however, the position of front guide 32 rarely has to be changed once the machine is initially set up for operation. For reasons that will become apparent later, Package P is indexed in its passage through the machine on the corner between its front and trailing edge and therefore any adjustments for width are made from the rear. The terms front and rear as used herein are related to the orientation of the film in sealing section 25. The folded edge of the film in that section is deemed to be the rear, and the free edges of the film the front.

Infeed conveyor 26 terminates adjacent table 41 of package inserting section 24. Guides 32 and 33 extend above infeed conveyor 26 parallel to each other to position just short of the position of roller 28. Preferably the surface of conveyor 26 is horizontal and therefore lead roller 27 is at the same elevation as trailing roll 28.

Figure 2:
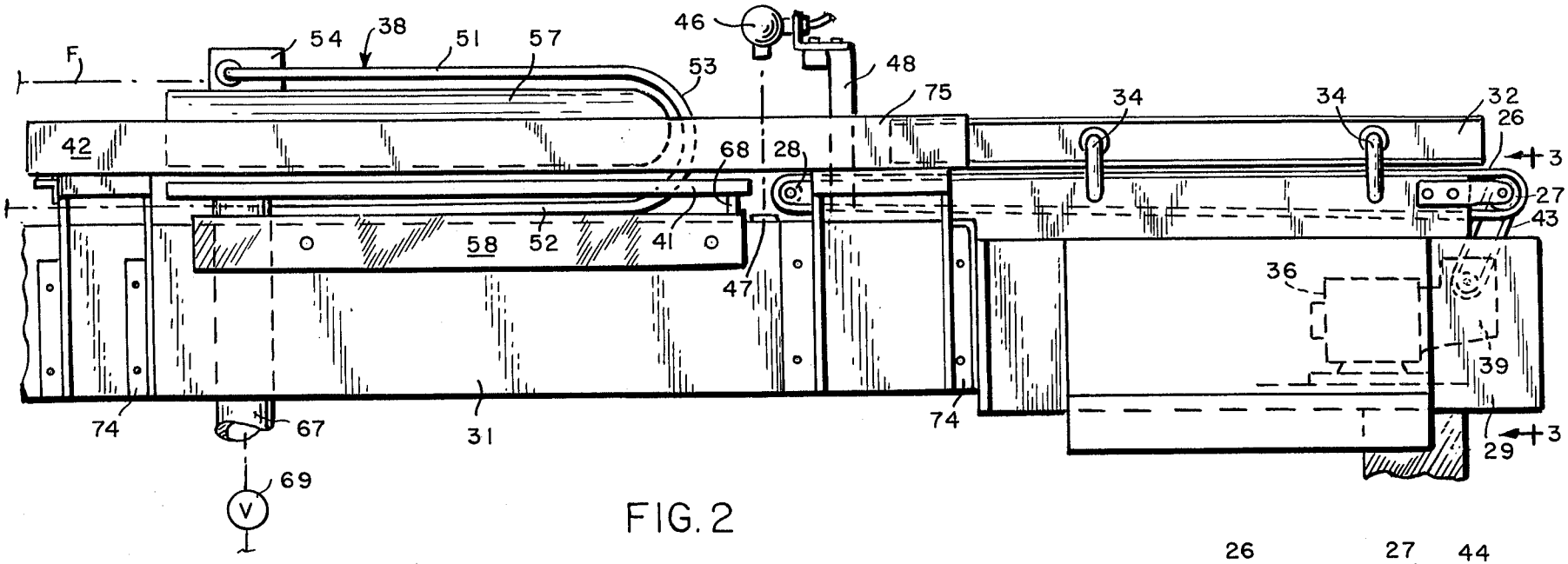
FIG. 2 is a front elevation of that portion of the apparatus indicated at 2—2 on FIG. 1.
Figure 3:
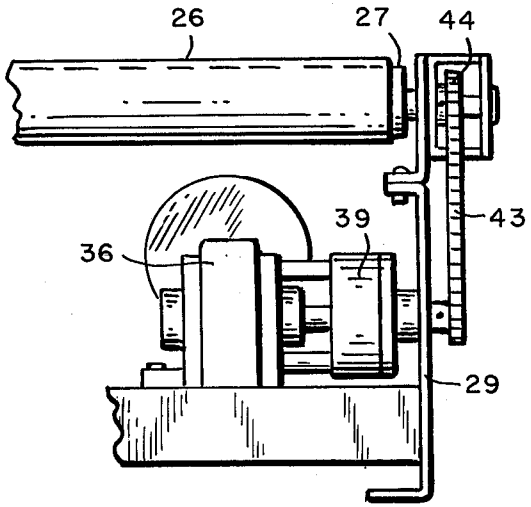
FIG. 3 is a detail partially in section along the line 3—3 of FIG. 2.

The packaging apparatus of the present invention operates intermittently as will be explained below and for this purpose infeed conveyor 26, as shown in FIG. 2, is powered by a motor 36 and a brake mechanism 39 connected by chain 43 to sprocket 44 on roller 27 as shown in FIG. 3 to permit conveyor 26 to start and stop on signal. Since the machine is particularly designed to handle articles that are likely to be damaged or to shift when subjected to sudden shock, motor 36 and brake 39 are adapted to start and stop infeed conveyor 26 at a smooth and controllable rate. Preferably motor 36 is a motor that starts with a relatively gentle starting torque and brake 39 is an electromagnetic brake, the power supply to which is controlled by a variable auto-transformer so that the stopping toque can be adjusted to any value from zero up to full torque.

The operating requirements of package infeed conveyor 26 are that it will deliver the packages P to be overwrapped one by one on demand onto table 41 of package inserting section 24. An electric eye device comprising a self-contained photo-electric cell-light source unit 46 and retro reflector 47 is provided in the space between package infeed conveyor 26 and table 41 of package inserting section 24 in such position that the light beam will be interrupted by the passage of a package P from infeed conveyor 26 to table 41. Photo cell unit 46 is mounted on bracket 48 which in turn is mounted on frame 31 in such position above the level of conveyor 26 and table 41 that the light beam will be reflected from retro reflector 47 which in turn is mounted on frame 31 below the level of conveyor 26 and table 41. The action of the electric eye device is such that after the light beam between photo cell light source unit 46 and retro reflector 47 has been interrupted by the passage of a package P therebetween the reactivation of the photo cell by the reappearance of the retro-reflected light beam as soon as package P crosses the space deenergizes motor 36 and energizes brake 39 to stop conveyor 26, as hereinafter described.

The film unwind and inverting section indicated generally at 23 are generally the same as disclosed in the referenced Shanklin patent and comprises a film unwind stand 37 and a film inverting head 38. Film unwind stand 37 is located to the rear of packaging apparatus 21 and is preferably oriented so as to cradle a roll 45 of center-folded film F in such manner that the axis of the roll 45 of film is parallel to the path of travel of packages through apparatus 21 and the film is directed into the machine at right angles to the path of travel of package P. Film unwind stand 37 is provided with a powdered unwind means adapted to provide film to inverting head 38 on demand in substantially a tension-free condition.

Film inverting head 38 is a U-shaped member oriented at an angle that bisects the angle between the path of packages P from right to left through apparatus 21 and the path of film F from unwind stand 37. Film inverting head 38 has parallel arms 51 and 52 both of which extend horizontally with the one arranged vertically above the other. Lower arm 52 extends beneath table 41 of package inserting section 24 and upper arm 51 is located above table 41 at a height sufficient to clear packages P. Film unwind stand 37 and inverting had 38 are substantially as disclosed in considerable detail in Shanklin U.S. Pat. No. 3,583,888, to which reference is made for details of construction and operation.

Package inserting section 24 comprises an infeed table 41 and reciprocating package inserting arm assembly 42. Air table 41 extends horizontally from adjacent the end of infeed conveyor 26 to adjacent sealing section 25 and passes through inverting head 38 just above lower arm 52 with sufficient clearance to permit the free passage of the lower portion of folded film F therebetween. As pointed out above, there is a slight gap between the end of infeed conveyor 26 and table 41 to allow for the passage of the light beam between photo cell light source unit 46 located above and retro reflector 47 located below. The level of the top of table 41 while substantially the same as that of infeed conveyor 26 is preferably arranged slightly below (in the order of between $\frac{1}{8}$ and $\frac{3}{8}$0 of an inch) to avoid the possibility of the leading edge of a package P hitting against the edge of table 41 in passing over the gap. This is particularly important where package P comprises a stack of thin flexible items such as, for example, a stack of sheets of writing paper, where the bottom sheet is likely to curl downwardly when passing over the gap.

Figure 4:
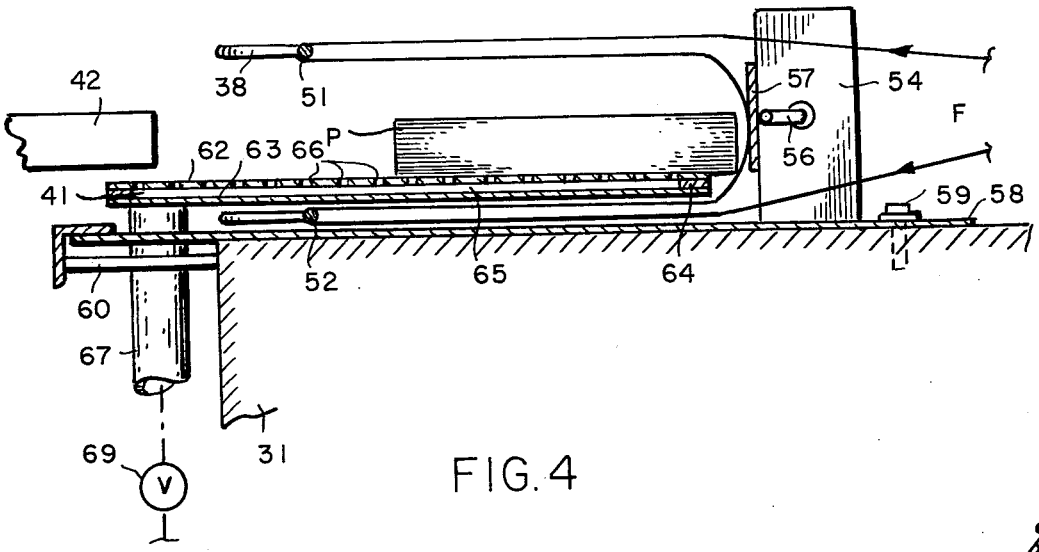
FIG. 4 is a section along line 4—4 of FIG. 1.
Figure 11:
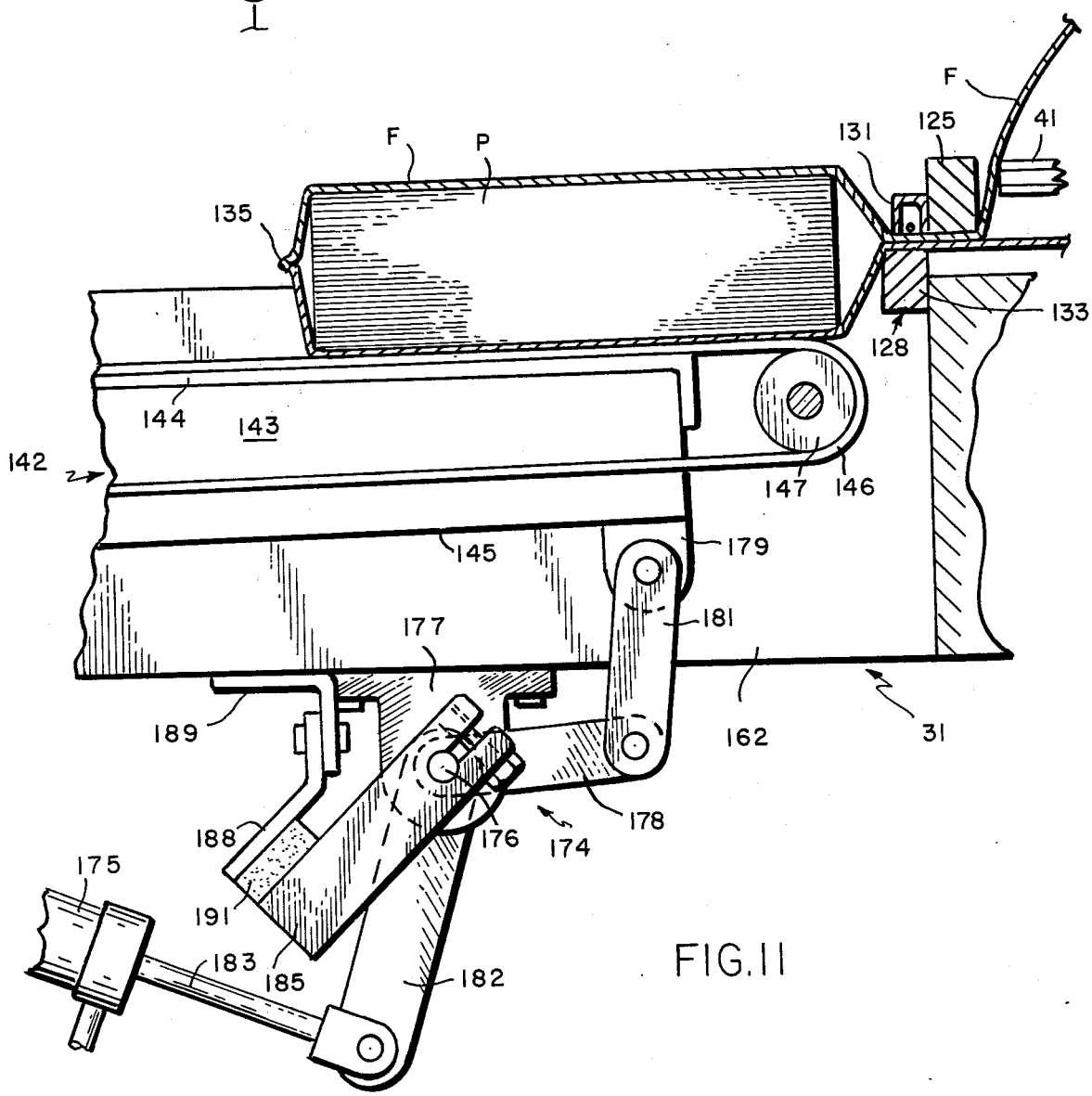
FIG. 11 is an enlarged portion of FIG. 10 partially in section showing the sealing table in its depressed position with a package being sealed.

Infeed air table 41 (see FIGS. 2, 4) comprises an upper plate 62, a lower plate 63 and a marginal separating and sealing strip 64 forming an air chamber 65. Upper plate 62 is provided with a plurality of apertures 66 extending from the top surface of plate 62 into air chamber 65. Each aperture 66 is provided with a widened portion adjacent the outer surface of upper plate 62 formed, for example, by drilling and counter-sinking the aperture. Air is supplied to chamber 65 from a blower or the like (not shown) through air pipe 67 which extends through lower plate 63 at the front lefthand corner clear of inverting head 38. Air table 41 is mounted on sliding support member 58 by supports 68 located within the area indicated within the dash lines shown in FIG. 1. Air table 41 is cantilevered over the remaining area to maintain the necessary clearance for the free passage of film to and around lower arm 52 of inverting head 38. Since both inverting head 38 and air table 41 are mounted on sliding support member 58, the relative position of the two remains constant and both the inverting head and the air table slide in and out for package width adjustment.

Air is supplied to chamber 65 through ball valve 69 and air pipe 67 at a volume sufficient to maintain a pressure of some 3 to 10 inches of water when ball valve 69 is wide open. Apertures 66 are arranged on upper plate 62 to provide a flow of air beneath packages P as packages P pass over table 41. Because a package with a small base area requires more apertures than a package with a large base area, the density of the apertures 66 is increased toward the rearward edge of a table 41 since this is the section of the table over which small packages travel. When package P passes over an aperture 66 the air is trapped beneath package P and the air in escaping lifts the package and floats it on a thin film of air. This reduces the friction or drag between the bottom of a package P and infeed table 41 to a very low value. This is particularly important when package P comprises a stack of relatively movable sheets so that the friction between the package and the infeed table may be made less than the friction between the sheets and that package P may move and be moved as a unit without the sheets in the stack moving relative one to the other. By adjusting the flow of air by changing the setting of ball valve 69 the residual friction or drag between package P and air table 41 which, of course, depends in large part on the weight per unit area of the package, can be controlled quite readily and quite precisely. If the air flow is insufficient and hence the residual friction or drag is excessive package P will tend not to transfer cleanly from infeed conveyor 26 onto table 41 or particularly in the case of a stack of sheets will tend to be dislodged while being advanced across table 41. On the other hand, if the friction or drag level is reduced excessively due to the fact that an excess volume of air is permitted to escape from apertures 66, package P will tend to float freely on the surface of air table 41 and to drift uncontrollably across the face of table 41 due to the momentum imparted to it by infeed conveyor 26. By adjusting the setting of ball valve 69 the volume of air supplied to air table 41 and hence the drag between table 41 and package P can be controlled very readily to the desired level.

Figure 5:
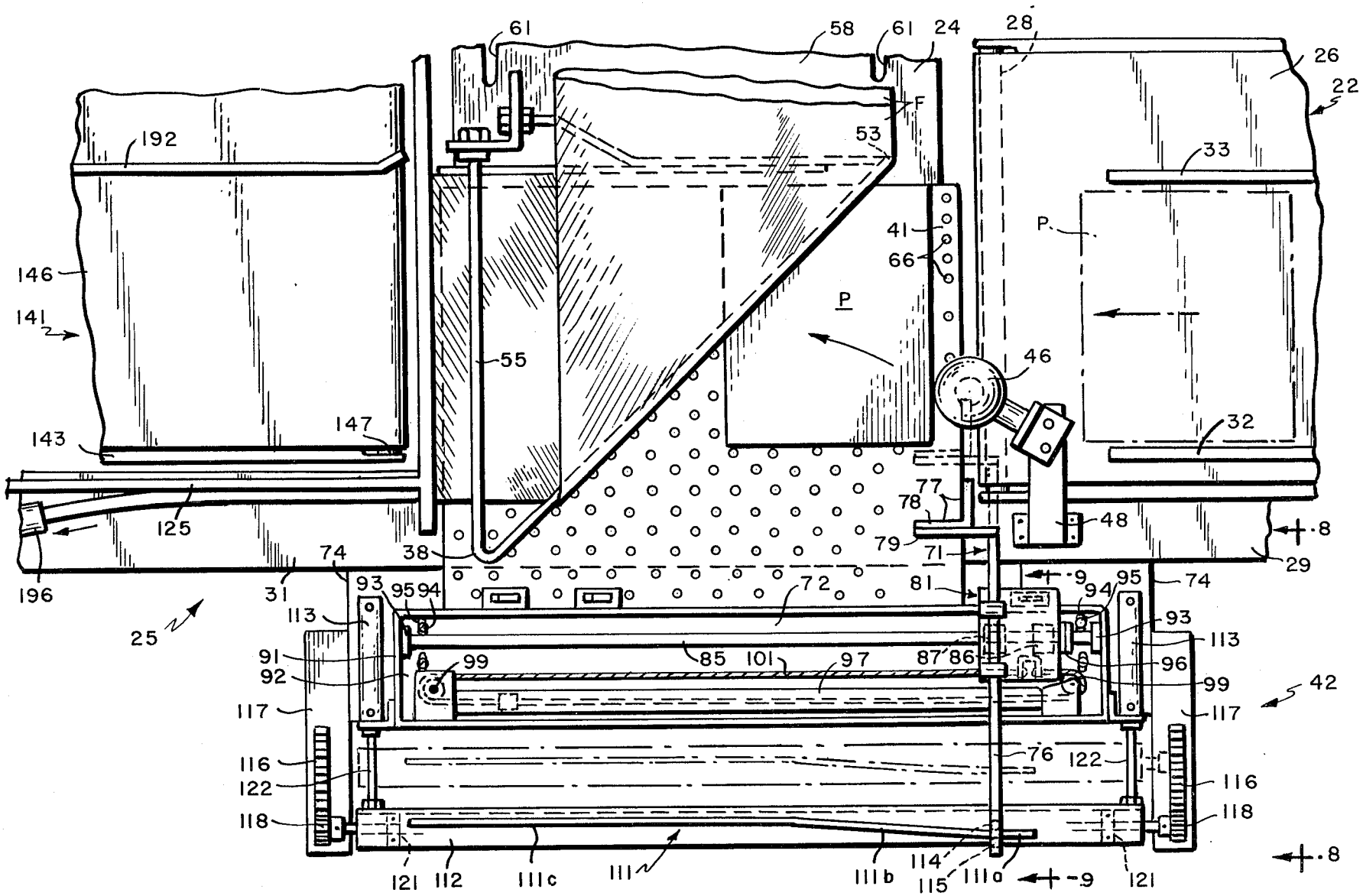
FIG. 5 is a plan view of the package insert portion of the apparatus with insertion cover removed.
Figure 8:
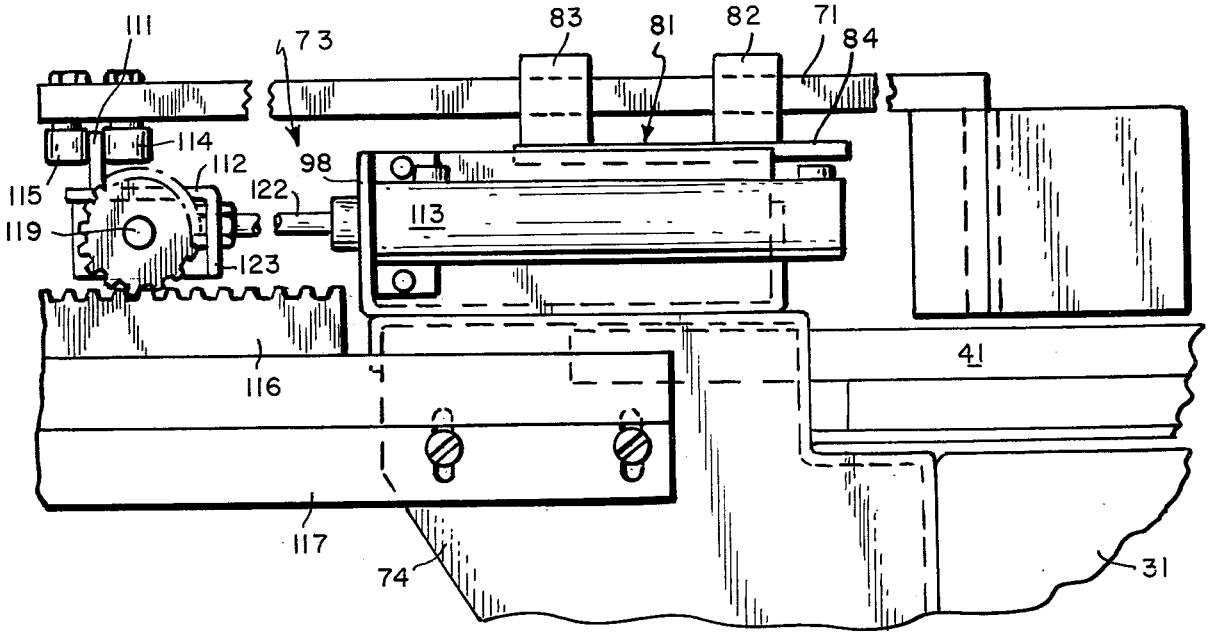
FIG. 8 is a side view along line 8—8 of FIG. 5.
Figure 9:
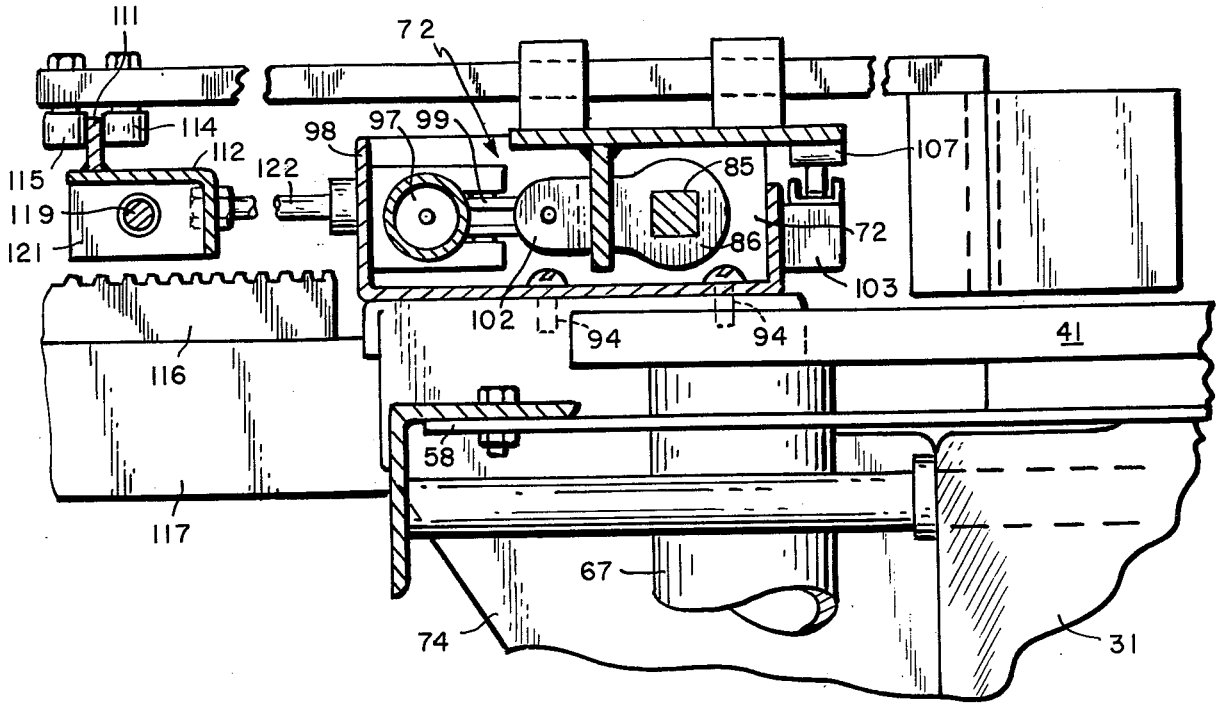
FIG. 9 is a side view partially in section along line 9—9 of FIG. 5.
Figure 10:
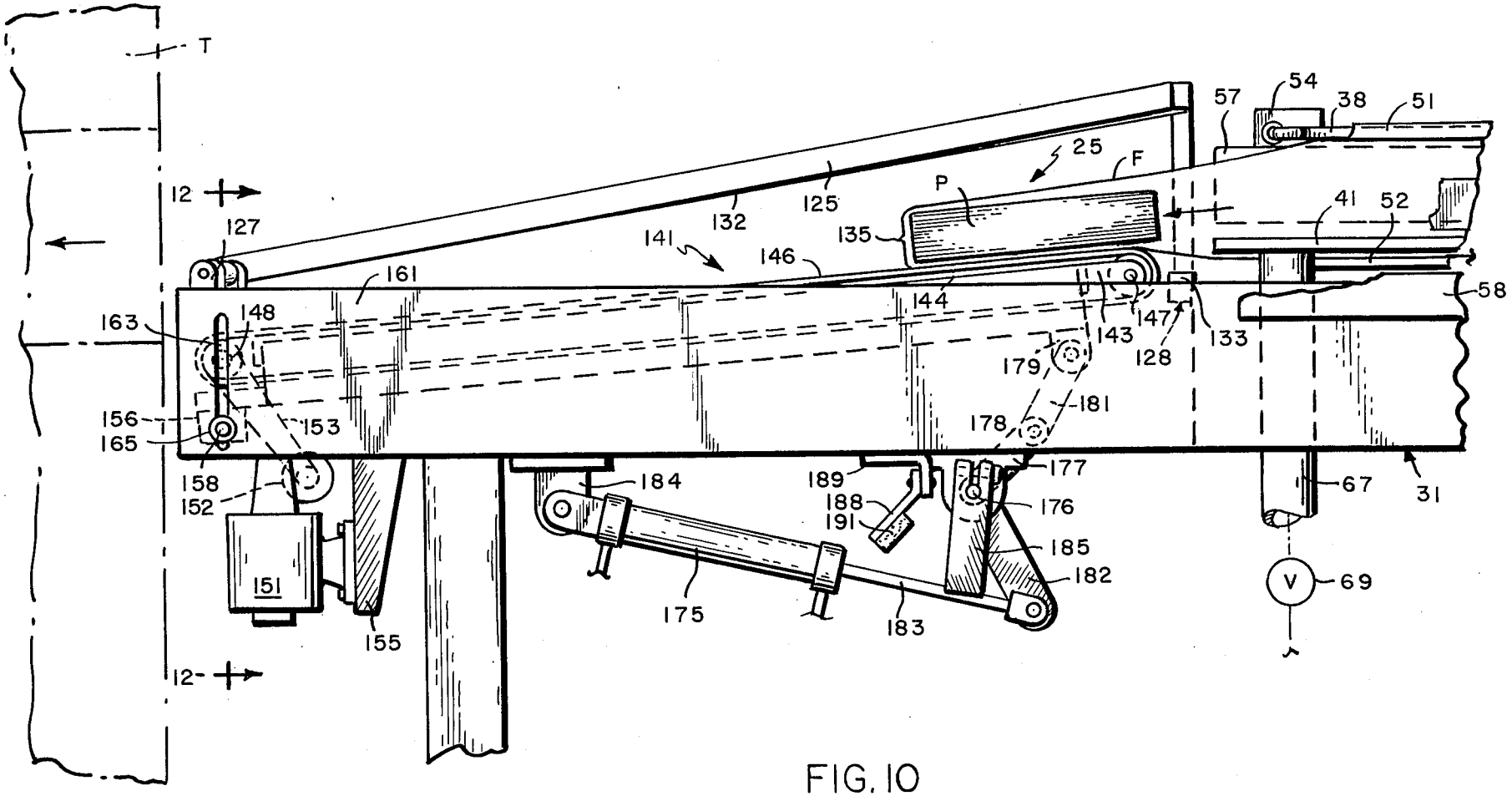
FIG. 10 is a front elevation of that portion of the apparatus indicated at 10—10 on FIG. 1.

Package insertion arm assembly 42 shown in detail in FIGS. 5, 8 and 9, comprises insertion arm 71, insertion arm drive mechanism 72 and insertion arm extension and retraction mechanism 73. Assembly 42 is mounted on brackets 74 which in turn are mounted on the front of main frame 31, one on either side of the location of sliding support member 58 and air table 41 at a height such that support member 58 and air table 41 can pass freely beneath assembly 42 and upper arm 51 of inverting head 38 may pass above assembly 42. This permits the position of inverting head 38 to be adjusted for package width while maintaining package insertion arm assembly 42 in a fixed position relative to frame 31. In practice insertion arm drive mechanism 72 and extension and retracting mechanism 73 are provided with a cover 75 as shown in FIG. 1. Cover 75 has been removed in the remaining views so that the details of the mechanism can be seen clearly.

Insertion arm 71 of insertion arm assembly 42 extends above air table 41 and comprises support arm 76 and head 77 mounted at one end thereof. Head 77 comprises a right-angled package contacting member 78 which is arranged vertically, terminating at the bottom at a position that just clears the top of air table 41 and is oriented to engage the corner between the front and the trailing edge of package P within the two sides thereof, and a support member 79 which connects package contacting member 78 with support arm 76. Package contacting member 78 is offset to the left of the axis of support arm 76 to facilitate the advance of a package P through inverting head 38 into sealing section 25. The height of package contacting member 78 is such that it will pass through film inverting head 38.

Support member 76 is mounted for reciprocal travel in and out on carriage 81 by means of a pair of bearing members 82 and 83 mounted on the top surface 84 of carriage 81. To maintain the vertical orientation of head 77 support arm 76 is square or rectangular in cross-section and passes internally of a bearing of corresponding cross-section formed of a suitable low-friction bearing material such as nylon or the like mounted in each of bearing members 82 and 83. Alternatively of course support arm 76 could comprise a pair of parallel rods passing through two pairs of suitable bearing members.

Carriage 81 in turn is mounted for reciprocal travel right and left on square or rectangular shaft 85 by means of a pair of bearing members 86 and 87 mounted on the rear face of downwardly extending flange 88 which extends beneath carriage 81. Each bearing member 86 and 87 contains a bearing element of corresponding cross-section to shaft 85 formed of a suitable low-friction bearing material such as nylon or the like through which shaft 85 passes. Rather than to use a square or rectangular bearing and a corresponding square or rectangular shaft to maintain the orientation of insertion arm 71 one could alternatively employ a pair of support shafts and two pairs of bearings.

Support shaft 84 is mounted between side flanges 91 of support housing 92 on mounting blocks 93. Support housing 92 extends between brackets 74 and is mounted on the top thereof in adjustable relation thereto as indicated by screws 94 and slots 95. Adjustment is normally made only during the initial assembly and set up of the machine. An adjustable stop 96 is provided on the right-hand end of support shaft 85 to limit the travel of carriage 81 and to properly position insertion arm 71 relative to package infeed section 22. An air cylinder 97 is provided mounted on the inner face of front flange 98 of support housing 92 to move carriage 81. The preferred air cylinder is of the type that is provided with a pulley 99 at both ends and with a cable 101 which passes around both pulleys and is attached to a piston within air cylinder 97. Cable 101 is attached at the midpoint thereof to bracket 102 mounted on the front face of downwardly extending flange 88 of carriage 81. Air cylinder 97 extends the full length of desired travel of carriage 81 and the action is such that as the piston moves in one direction carriage 81 moves in the opposite direction. Three limit switches, rearward limit switch 103, seal arm operation limit switch 104 and forward limit switch 105 are provided mounted on the outer surface of rear flange 106 on support housing 92 and the undersurface of the top surface 84 of carriage 81 is provided with a downwardly depending contact block 107 adapted to contact the control arm of each said limit switch as carriage 81 passes to and fro along shaft 85.

Insertion arm 71 is extended and retracted by retraction member 73 which comprises a cam track 111 mounted in upstanding relationship on top of cam track support member 112 and a pair of air cylinders 113 mounted on the outer surface of side flanges 91 at each end of support housing 92. Cam track 111, a fin-like member, is contacted on either side by one of a pair of roller cam followers 114 and 115 mounted on the underside of support arm 76 of insertion arm 71 adjacent the end remote from head 77. In order to maintain the precise alignment of retraction member 73 a rack and pinion arrangement is provided on each end. In each case rack 116 is mounted on rack support bracket 117 which in turn is mounted on the outer side of bracket 74. Each pinion 118 is mounted on a common pinion shaft 119 which in turn is mounted by bearing members 121 on the underside of cam track support member 112. Piston rods 122 of air cylinder 113 are attached to rear flange 123 of cam track support member 112. The movement in and out of piston rods 122 of air cylinders 113 extends and retracts insertion arm 71 by a pre-set distance, usually about 3 inches. Cam track 111 is provided in three segments, two of which 111*a* and 111*c* are arranged parallel to support shaft 85 but are offset from one another by a distance of about one inch with the lefthand segment 111*c* located toward the rear of the machine relative to righthand segment 111*a* and the intermediate segment 111*b* joining the two at a relatively gentle slope.

Figure 6:
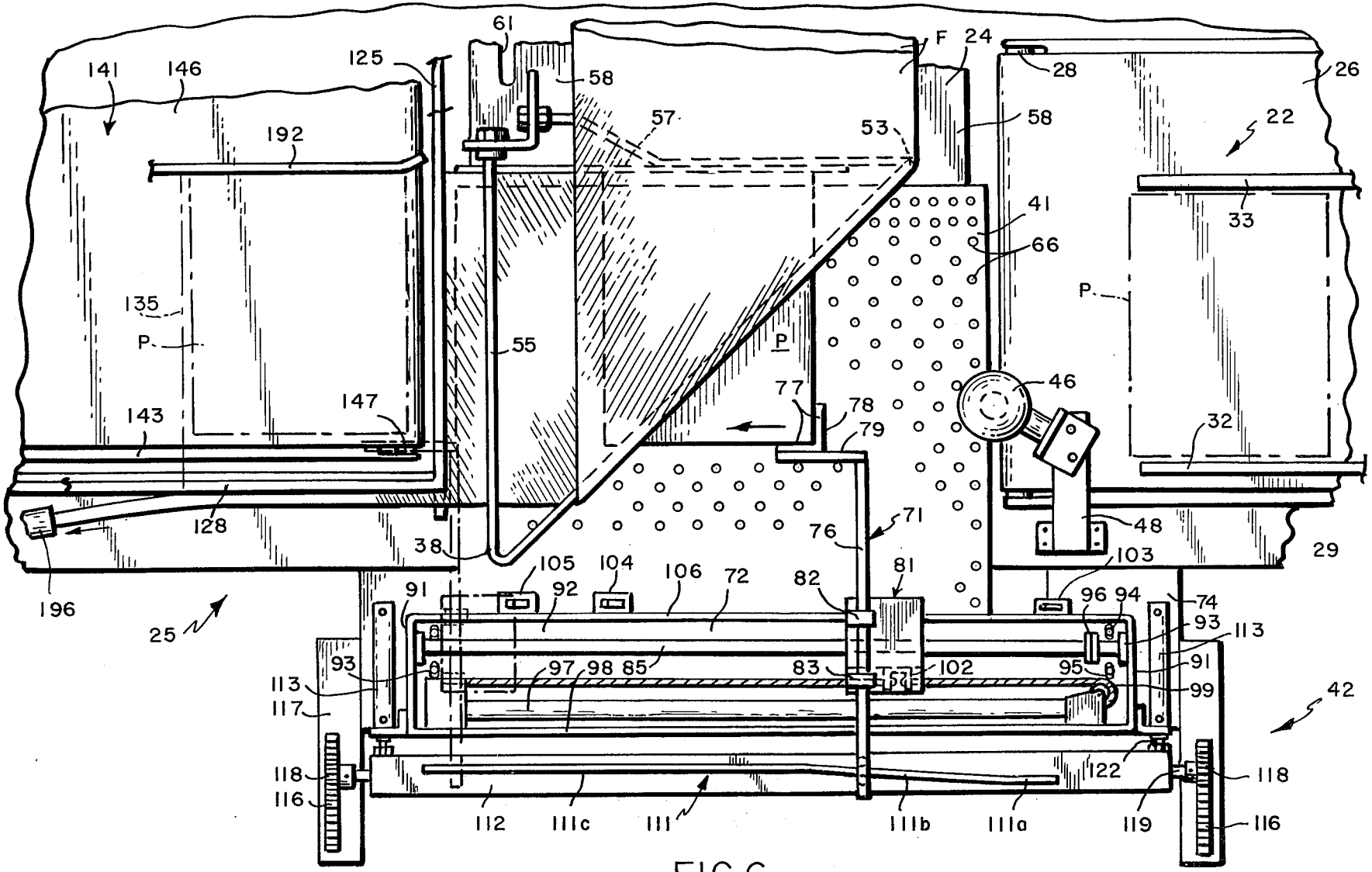
FIG. 6 is a plan view corresponding to FIG. 5 but with a package in transit across the air table in contact with the package insertion arm.
Figure 7:
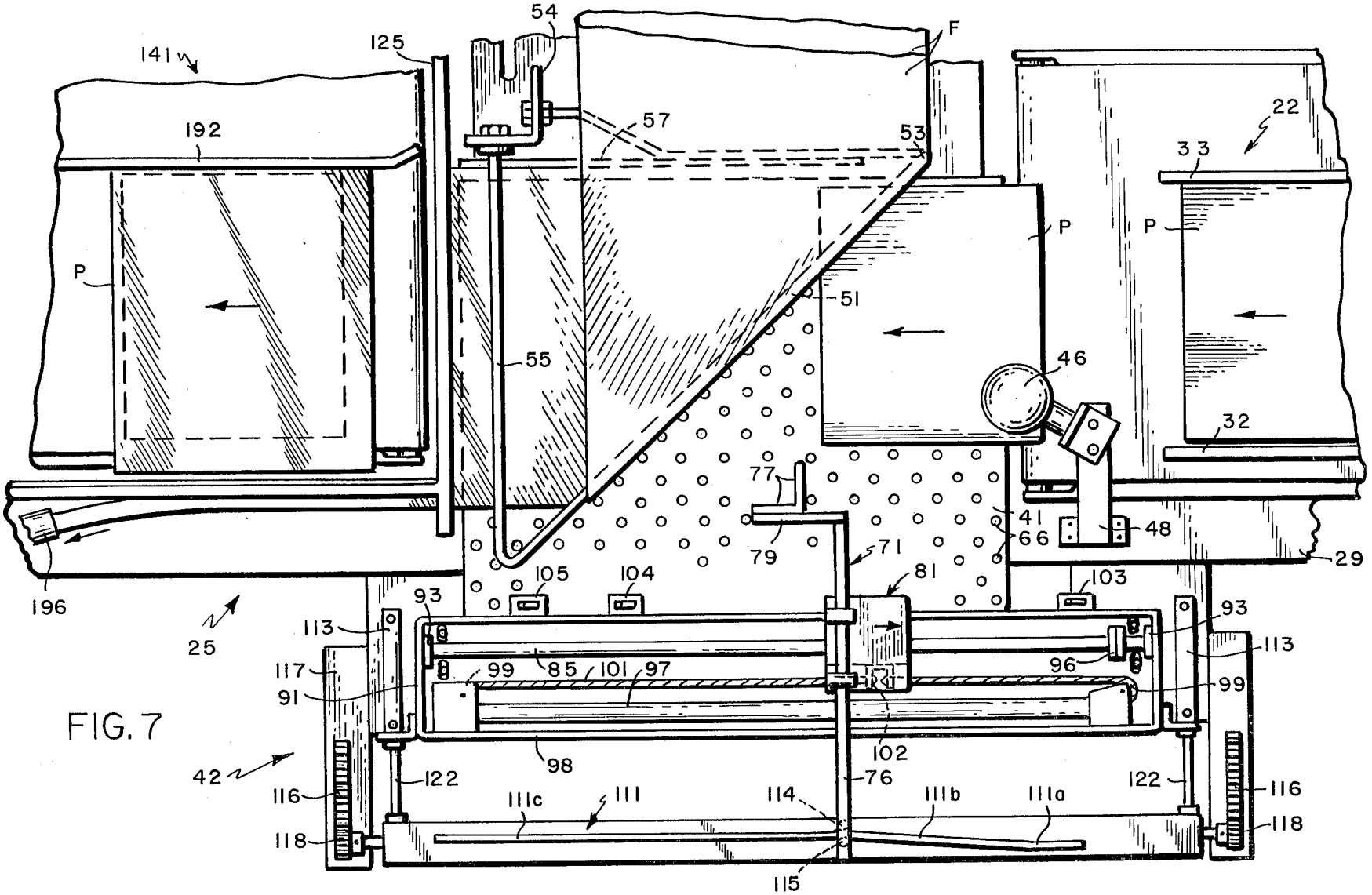
FIG. 7 is a plan view corresponding to FIGS. 5 and 6 but with the package insertion arm shown during the return stroke.

In operation as shown in FIGS. 5, 6 and 7, after a package P has been advanced on package infeed conveyor 26 of package infeed section 22 onto air table 41 of package insertion section 24 and has passed the beam of photocell unit 46 and if carriage 81 has returned to contact with stop 96 where limit switch contact block 107 on carriage 81 is in contact with limit switch 103, the package insertion stroke is initiated. In the first step air cylinders 113 are actuated to retract piston rods 122 to move cam track support member 112 of extension and retraction member 73 to a position adjacent carriage 81. This extends insertion arm 71 so that head 77 comes into a position surrounding the corner between the front and trailing edge of package P. As soon as insertion arm 71 is extended air cylinder 97 is actuated through an adjustable time delay relay TDRI (the control circuit including such relays is hereinafter described) to advance package insertion arm 71 of insertion arm assembly 42 toward sealing section 25. As carriage 81 moves from right to left and as cam followers 114 and 115 of insertion arm support arm 76 move along cam track 111 from segment 111*a* along segment 111*b,* head 77 comes into contact with the front edge and the trailing edge of package P at the corner between the two and gently advances package P while positioning the rear of package P into contact with the rear guide 57 mounted on rear brace 56 of inverting head 38.

As the trailing edge of package P is passing into sealing section 24, block 107 on carriage 81 contacts limit switch 105. This activates time delay relay TDRX which after the adjustable time delay period expires simultaneously causes the reversal of the air flow to air cylinder 97 for carriage 81 and air cylinders 113 for cam track support member 112. This simultaneously retracts insertion arm 71 and starts it return toward package insertion section 24. At the same time package infeed conveyor 26 is reactivated. As carriage 81 returns contact block 107 passes over limit switch 104 which activates sealing section 25 and causes initiation of the sealing cycle. Limit switch 104 is positioned so that head 77 of insertion arm 71 will be clear of upper sealing assembly 125 before the seal arm closes.

Although in the preferred embodiment an insertion arm 71 which extends and retracts has been shown, it should be clear that alternate means of removing the insertion arm from the path of package flow during its return stroke can be used, such as, raising the arm over the package, or returning the arm under the infeed table 41. A continuous belt around the infeed table may also be used.

Sealing section 25 is in certain detail the device described and claimed in Shanklin U.S. Pat. No. 3,490,981. Reference to said patent is specifically made for the details of the construction and operation of sealing section 25, not hereinafter described.

Figure 13:
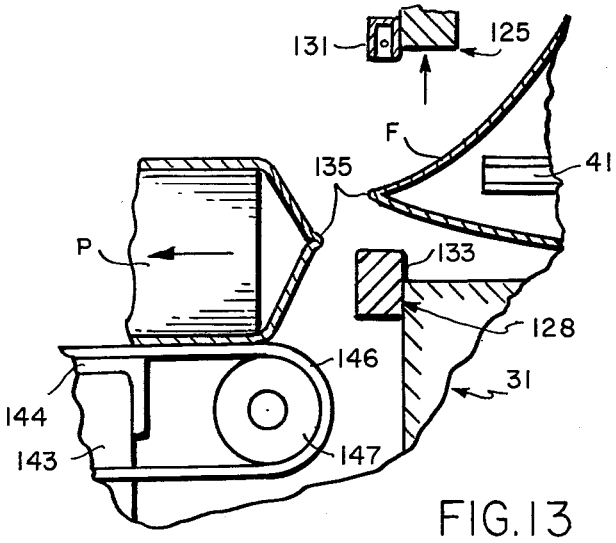
FIG. 13 is an enlarged portion partially in section corresponding to FIG. 11 but immediately after the sealing operation is completed.
Figure 12:
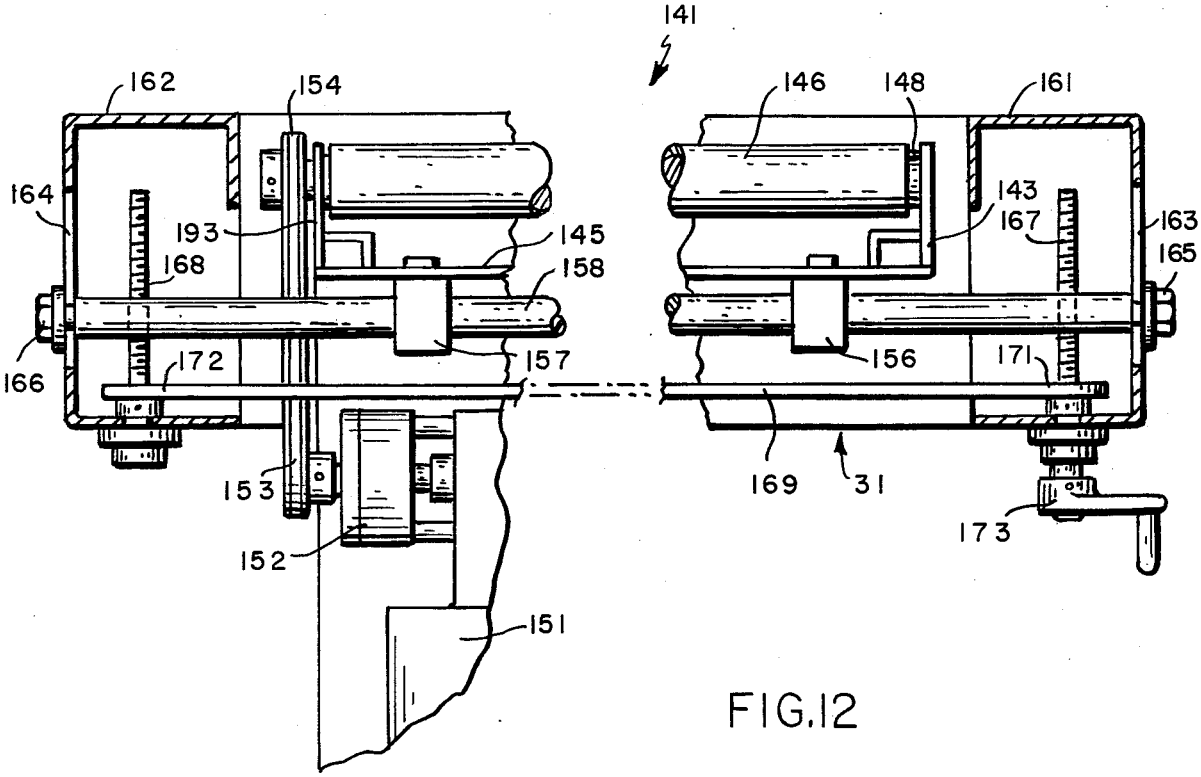
FIG. 12 is an end view partially in section of the sealing table taken along line 12—12 of FIG. 10.

Referring to FIGS. 12, 13, in essence, sealing section 25 comprises an upper sealing assembly 125, an L-shaped member pivotally mounted at each end as indicated at 126 and 127 along a diagonal pivot axis for reciprocal motion above this axis, and a lower sealing assembly 128 mounted in a fixed position on frame 31. Lower sealing assembly 128 is located at a level on main frame 31 such that the top surface of the lower transverse sealing jaw 133 is lower than the level of the top of air table 41 so that package P will pass over readily upon being transferred from package insertion section 24 into sealing section 25 by the advance of package insertion arm 71. At this point, of course, package P is supported on the lower web of film F. Means (not shown herein) are provided as described in U.S. Pat. No. 3,490,981 to lower and raise upper sealing assembly 125 and to actuate the sealing cycle on signal. Preferably the sealing jaws are of the so-called impulse type designed not only to form a seal between the two layers of film F but also to sever the film along the middle of the seal leaving a sealed area on both sides of the severed portion.

Figure 14:
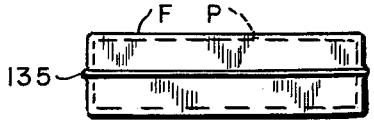
FIG. 14 is a side view of a sealed package.

It is quite important in the case of folded film that the distance that the film travels around the bottom of the package should always be equal to the distance that the film travels around the top of the package when the film is joined at the fold at the rear of the package. Since this distance should also be equal left and right as well as front to rear the seal should be at the center of the package. This condition is satisfied where the seal line 135 in the film F around three sides of package P intersects the fold line in the film and both the seal line and fold line are located approximately at the midpoint between the top and bottom of package P as shown in FIG. 14. To accomplish this desired result, the sealing area of the conventional L-sealer is provided with a sealing table located within the sealing jaws of the L-seal between which the package rests during the sealing operation. The sealing table is adjustable in height relative to the sealing jaws so that the seal may be located at the midpoint between the top and bottom of the package. Since the seal is made when the overlapping layers of film are in contact with the lower sealing jaws this means that in passing over the sealing jaws into the sealing area package P drops a distance equal to one-half of its height onto the sealing table, a condition which is undesirable should package P consist of the relatively fragile or relatively shiftable elements of concern in the machine of the present invention.

To avoid this drop, sealing table 141 of sealing area 25 in the packaging apparatus 21 of the present invention is arranged to pivot around its discharge end so that a package P may be received from air table 41 without any substantial downward displacement and subsequently lowered to the proper sealing position. Referring particularly to FIGS. 10, 11, 12 and 13, sealing table 141 comprises sealing table frame 142, box-like element comprising side members 143, top plate 144 and bottom plate 145 both mounted between side member 143. Sealing table frame 142 extends between a point adjacent lower transverse sealing jaw 133 and the discharge end of packaging apparatus 21 which in the normal arrangement is in close juxtaposition with a shrink tunnel indicated diagrammatically at T. A discharge conveyor 146 is arranged over top plate 144 and leads between top plate 144 and lower plate 145 mounted on rollers 147 and 148 respectively, which rollers are mounted on an extension of side members 143 at either end thereof. By pivoting the discharge end of the discharge conveyor, the elevation level of the package discharge is maintained constant, thus permitting the package to be smoothly transferred to a fixed elevation conveyor such as would be used in shrink tunnel T.

Discharge conveyor 146 is powered by a similar arrangement as infeed conveyor 26, namely a motor 151 connected through an electromagnetic brake 152 to drive chain 153 which runs over an appropriate sprocket 154 at one end of roller 148. The motor brake assembly is mounted on a bracket 155 fastened to the underside of sealing table frame 142. A variable auto transformer is provided to adjust the stopping torque of brake 152.

Sealing table frame 142 is mounted at the end adjacent tunnel T by means of a set of pivot bearings 156 and 157 fastened to the underside of bottom plate 142 at a point beneath roller 148 to a shaft 158 which in turn is fastened at each end to the sides 161 and 162 of main frame 31. To provide for the vertical adjustment of the discharge end of discharge conveyor 146 mounting shaft 158 passes through slots 163 and 164 provided in sides 161 and 162 respectively and is fastened thereto by lock nut washer combination 165 and 166. Vertical adjustment is accomplished by means of a pair of vertically oriented screw shafts 167 and 168 rotatably mounted in sides 161 and 162 respectively which pass through tapped apertures provided therefor in mounting shaft 158. Screw shafts 167 and 168 are connected by drive chain 169 passing around sprockets 171 and 172 on shafts 167 and 168 respectively and a crank 173 is provided on an extension of shaft 167 to drive both shafts simultaneously. To adjust the height of the discharge end of conveyor 146 lock nuts 165 and 166 are loosened, crank 173 rotated to bring the discharge end of conveyor 146 to the desired level and the lock nuts 165 and 166 tightened. Since when the height of the discharge end of discharge conveyor 146 is changed the height of the conveyor in tunnel T must also be changed such adjustment is normally made only when there is a large change in the height of package P.

The receiving end of sealing table 141 is adapted to reciprocate between a package receiving elevation and a package sealing elevation by means of a bell crank arrangement 174 actuated by an air cylinder 175. Crank shaft 176 is mounted beneath main frame 31 on a pair of pillow blocks 177 affixed to the undersides of sides 161 and 162 respectively. Upper arm 178 of bell crank 174 which is affixed to shaft 176 just inside of pillow block 177 is attached to pivot block 179 mounted on the underside of sealing table frame 142 adjacent roller 147 by means of toggle link 181. Lower arm 182 of bell crank 174 is pivotally attached to piston rod 183 of air cylinder 175 and the other end of air cylinder 175 is pivotally attached to side 161 of frame 31 at bracket 184. A similar toggle link (not shown) is provided at the other end of shaft 176 for the other side of sealing table frame 142. Since the bell crank arrangement can be actuated by a single air cylinder, a second air cylinder and correspondingly the lower arm of the bell crank can be omitted.

The arrangement is designed so that when piston rod 183 of air cylinder 175 is fully extended the top of discharge conveyor 146 adjacent lower transverse sealing jaw 133 and air table 41 will be slightly lower in the order of $\frac{1}{8}$ to $\frac{3}{8}$ inch than air table 41 so that a package P may pass readily from air table 41 to conveyor 146. Once the apparatus is set up this adjustment normally does not have to be changed. The lower position of sealing table 141 is regulated by regulating the angular position of arm 185 relative to shaft 176. Arm 185 is provided with a split end section 186 which can be tightened around the end of shaft 176 by means of fastening bolt 187 passing through the ends of split clamp section 186. A stop 188 mounted underneath side 161 of frame 31 on bracket 189 is provided to limit the swing of arm 185. A resilient pad 191 mounted on the face of stop 188 reduces the shock when stop 185 comes into contact. By adjusting the angular position of stop arm 185 the lowered position of sealing table 141 can be adjusted very accurately so that package P may be maintained at the desired position during the sealing operation. Arm 185 is normally adjusted each time the height of package P is changed. Where, as is normally the case, the length of package P is substantially less than the length of sealing table 141, the angular relationship is such that a fairly wide range of package heights can be accommodated without necessitating the adjustment of the height of mounting shaft 158 at the discharge end of table 141.

A package guide 192 is provided above discharge conveyor 146 toward the rear side of sealing table 141. Guide 192 is mounted on bracket 193 which is attached to sealing table 141 by rods 194 and 195 so that the position of guide 192 may be adjusted for varying package widths.

In normal operation air cylinder 175 is actuated simultaneously with upper sealing assembly 125 so that sealing table 141 is depressed as the sealing arm comes down and is elevated as the sealing arm goes up. Discharge conveyor 146 is stopped during this sealing cycle, but runs continuously at all other times. Conveyor 146 is stopped by deactuating motor 151 and actuating brake 152 through time delay relay TDRX actuated by limit switch 105 simultaneously with reversal of movement of carriage 81. Motor 151 is reactivated upon completion of the sealing cycle. The speed of discharge conveyor 146 is regulated to be approximately equal to the speed of advance of insertion arm 71 so that the transfer of a package P from air table 41 to conveyor 146 can take place as smoothly as possible. The position of the front of package P relative to the lower longitudinal sealing jaw 134 is determined by the position of head 77 of insertion arm 71. The position of the trailing end of package P on sealing table 141 relative to transverse sealing jaw 133 is determined by the length of the time delay of time delay relay TDRX after relay TDRX is activated by limit switch 105.

A scrap removal tube 196 is provided to facilitate the removal of film F. Tube 196 is normally connected to a source of vacuum such as a conventional shop vacuum cleaner.

Figure 15:
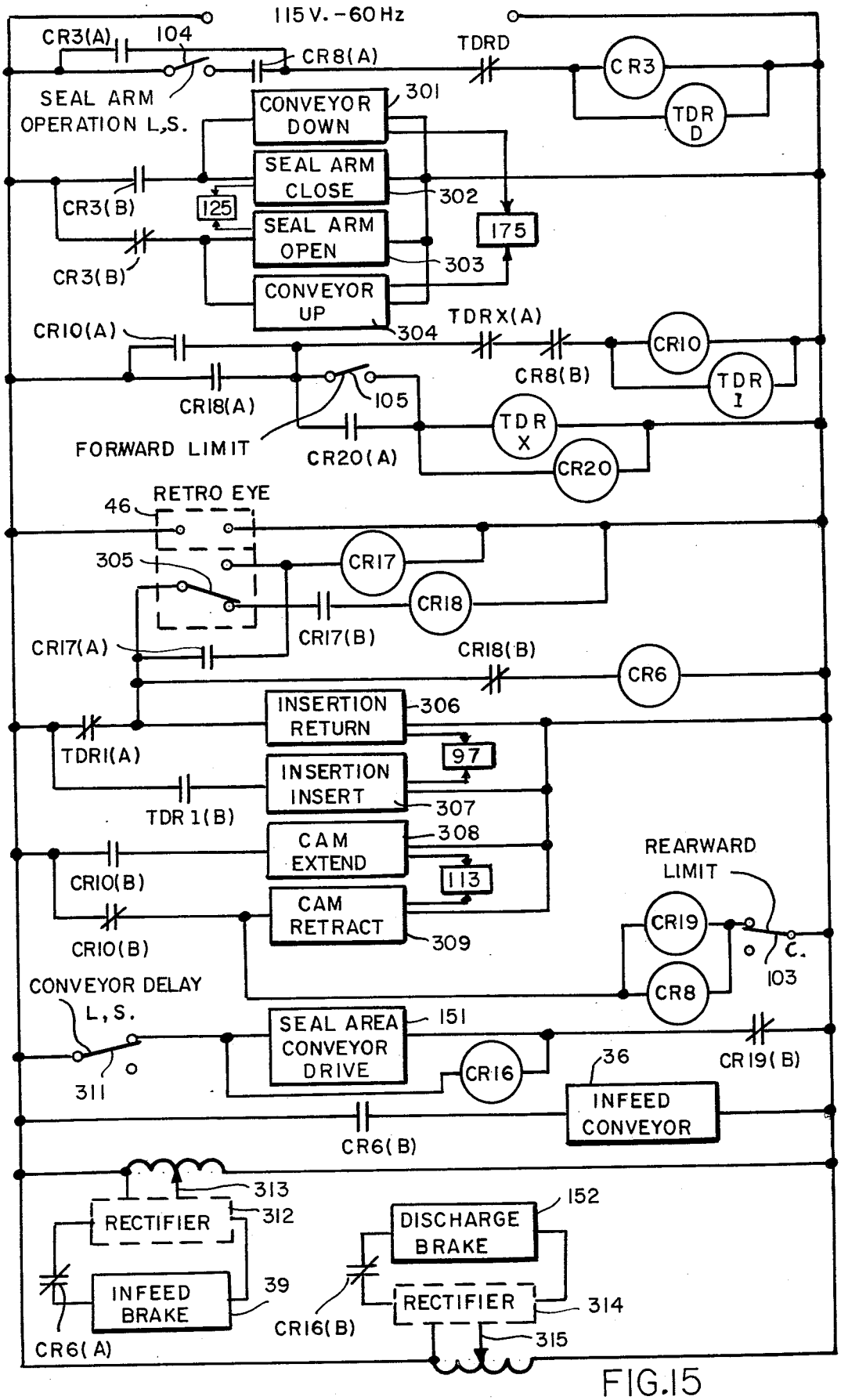
FIG. 15 is a wiring diagram of the electrical control circuit.

Referring now to FIG. 15, the wiring diagram of the controller circuit will now be described. This circuit is energized from the 115 volt 60Hz power source upon closing a main power switch, not shown. Connected across the AC power source are the following circuits.

A control relay CR3 and a time delay dwell relay TDRD are connected in parallel and through normally closed contacts of TDRD, normally opened contacts of a control relay CR8A and normally opened contacts 104 of seal arm operate limit switch, the latter two contacts being paralleled by normally opened contacts of a control relay CR3A.

A conveyor down actuator 301 and a seal arm close actuator 302 are connected to be operated through normally opened contacts CR3B. A seal arm open actuator 303 and a conveyor up actuator 304 are connected through normally closed contacts CR3B to the AC power. The conveyor down actuator 301 and the conveyor up actuator 304 operate to supply the appropriate actuating air to actuate a piston 175 as indicated.

A control relay 10 and a time delay relay TDRI connected in parallel are connected through normally closed contacts CR8B and TDRXA to the parallel combination of normally opened contacts CR10A and CR18A and thus to the AC power.

A time delay relay TDRX and a control relay CR20 connected in parallel are connected through the parallel combination of normally opened contacts CR20A and forward limit switch 105 to the parallel combination of normally opened contacts CR10A and CR18A and thus to the AC power.

The retro-eye 46 is connected across AC power and is adapted when the light beam is interrupted to actuate a transfer contact 305 to a normally opened contact connected with a control relay CR17 which is thus energized. When the light beam is not interrupted contact 305 is in the position shown and a control relay CR18 is energized through a circuit which includes normally opened contact CR17B. Both circuits just described for CR17 and CR18 to be energized through transfer contact 305 include the further circuit through normally closed contacts TDRIA. The circuit for energizing CR17 through transfer contact 305 is paralleled by normally opened contact CR17A.

A control relay CR6 is connected through normally closed contacts CR18B and normally closed contacts TDRIA across AC power.

An insertion return actuator 306 is connected to be energized through normally closed contacts TDRIA. An insertion insert actuator 307 is connected to be energized through normally open contacts TDRIB. The insertion return and insertion insert actuators supply operating air to actuating cylinder 97 which controls the insertion arm.

A cam extend actuator 308 is connected through normally open contacts CR10B to a AC power and a cam retract actuator 309 is connected through normally closed contacts CR10B. The cam extend actuator 308 and the cam retract actuator 309 are connected to supply air pressure to operate actuator 113.

Rearward limit switch 103 has a normally closed position which, except when actuated by insertion arm cam 107, connects one side of the line to control relay CR19 and control relay CR8 connected in parallel which are connected to the other side of the line through normally closed contacts CR10B.

The seal area conveyor 151 and a control relay CR16 are connected in parallel and energized from the AC power through a normally closed contact CR19B and the normally closed conveyor delay limit switch 311. Conveyor delay limit switch 311 opens when the seal jaws are closed making a seal thus interrupting during this interval the actuating circuit for seal arm conveyor 151 and control relay CR16.

Infeed conveyor 36 is controlled by normally opened contacts CR6B.

The infeed brake 39 is controlled through normally closed contacts CR6A from an adjustable DC voltage supply 312, the magnitude of which is selected from autotransformer tap point 313.

The discharge brake 152 is controlled through normally closed contacts 16B at a variable DC voltage from supply 314 which is controlled by an autotransformer at adjustable tap 315.

The operation of this circuit will now be described.

With the infeed conveyor 26 running and prior to the arrival of the leading edge of a package at the retro-eye 46, CR3 is deenergized and CR10 is deenergized leaving the cam 111 retracted. TDRI is deenergized leaving the insertion arm 26 returned against the rearward limit switch 103. Since the rearward limit switch 103 is operated to open circuit by insertion arm 26 at the extreme right position, CR8 and CR19 are both deenergized. Since the seal arm 125 is in its elevated position and CR3 deenergized, the conveyor delay limit switch 311 is making contact and the seal area conveyor 141 is up and running and CR16 is energized, deactivating the discharge brake 152. In addition, CR6 is energized operating the infeed conveyor motor 36 and deactivating the infeed brake 39.

When the leading end of a package passes through the retro-eye 46, transfer contact 305 energizes CR17 which seizes through contacts CR17A. When the trailing end of the package passes through the eye 46, the contact 305 returns and energizes CR18 through contacts CR17B. When CR18 is energized it deenergizes CR6 stopping the infeed conveyor 35 and applying the infeed brake 39. At the same time contacts CR18A energize CR10 and TDRI through normally closed contacts TDRXA and CR8B. When CR10 is energized it seizes through contacts CR10A. Contacts CR10B actuate the cam extend 308 and after TDRI has timed out contacts TDRIB activate the insertion insert 307 moving insertion arm 71 by actuator 97. The delay of TDRI provides the sequential timing that permits the cam 111 to extend before the insertion arm 71 starts its insertion motion.

When the insertion arm 71 reaches the forward limit switch 105 it operates the limit switch, closing contact 105 to energize TDRX and CR20. Contacts CR20A seize TDRX in the event that the insertion arm 71 travels past the forward limit switch 105. TDRX permits the seal area conveyor 151 to keep operating for a predetermined time delay as arm 71 continues its travel, and by adjusting this time delay, the position of the package in the seal area can be adjusted. When TDRX times out, it deenergizes CR10 and TDRI to energize insertion return 306 and cam retract 309 causing the insertion arm 71 to return and the cam 111 to retract simultaneously. During the return and retracting strokes CR6 is energized through contacts TDRIA and CR18B thereby starting the infeed conveyor motor 36 and releasing the infeed brake 39 to commence feeding another package onto the infeed table 41. Thus, the return of the insertion arm 71 takes place at the same time as the infeeding of the next package onto the air table 41. Note that contacts CR18B have previously reclosed during the insertion stroke but power will not reach CR6 because contacts TDRIA are open.

As the insertion arm 71 starts its return stroke it passes over the seal arm operate limit switch 104 energizing CR3 and TDR Dwell which seize through contacts CR3A. It should be noted that this can only happen when CR8 is energized and CR8 is energized only on the return stroke since, although rearward limit switch 103 is closed, CR8 is energized with the cam retract valve 309 only upon reclosing of contacts CR10B when CR10 is deenergized by TDRX. Thus, when the insertion arm 71 passes over the arm operate limit switch 104 in the insertion direction, it does not cause the seal arm 125 to operate, but when the insertion arm 71 passes over switch 104 on the return stroke the seal arm 125 closes. Contacts CR3B energize 301 and 302 to cause the seal arm 125 to close and the seal area conveyor 141 to drop. Note that seal area conveyor 141 is raised and lowered by air cylinder 175. After TDR Dwell has timed out, it deenergizes CR3 closing contacts CR3C to energize 303 and 304 causing the seal arm 125 to open and the seal area conveyor 141 to rise.

It should be noted that when CR10 is deenergized by TDRX (when the package is in position for sealing) CR19 is energized causing the seal area conveyor 141 to stop and engaging the discharge brake 152. At such time as the insertion arm 71 reaches rearward limit switch 103 and at such time as the seal arm 125 has raised sufficiently to permit the conveyor delay limit switch 311 to close, the seal area conveyor 141 will again operate and the discharge brake 152 will again deenergize. This is accomplished by deenergizing CR19 with the rearward limit switch 103 and energizing the seal area conveyor drive 151 and CR16 through the conveyor delay limit switch 311 as the seal arm 125 opens. Thus, the conveyor drive 151 is in effect stopped by opening contacts CR19B and as CR19 energizes and started again by conveyor delay limit switch 311 after CR deenergizes.

The sealing wire heating circuit is energized by a limit switch located at the front of the seal arm actuated as the seal arm 125 closes. This switch and circuit are not shown.

We claim:

1. The method of automatically overwrapping loose assembled groups of like items in an L-sealer having an inverting head comprising the steps of successively supporting said groups on a substantially horizontal plane to travel in substantially a straight line successively through an infeed area, an overwrap area and a sealing area;

intermittently feeding said groups on said infeed area to be transferred one group at a time to said overwrap area;

supporting on an air film substantially the whole weight of the group in said overwrap area;

operating a cycle for engaging the trailing edge of the group of said items supported on said air film and driving the so engaged group through said inverting head to said sealing area thereby overwrapping said group;

completing an L-sealing operation on the overwrapped group of articles in said sealing area consisting essentially of the sequence of withdrawing from said sealing area the means used for engaging and driving said group, lowering the level of said sealing area by approximately half the height of said group as assembled, simultaneously forming an L-seal and returning the engaging and driving means to initial position while feeding the next of said groups on said infeed area to said overwrap area, and returning said sealing area to the level of said plane as the sealed overwrapped group is conveyed away from said sealing area.

2. An automatic in-line L-sealer characterized by package transfer through the machine in a linear path at substantially uniform level comprising:

a substantially horizontal in-feed conveyor aligned with said path and driven by means for gradually accelerating and decelerating the conveyor;

a base member having a substantially horizontal table mounted thereon and aligned with said path for receiving a package deposited by said infeed conveyor, the surface level of said table being just below the discharge level of said infeed conveyor;

a film inverting head mounted on said base member to move with said table;

means for supplying a web of folded film transverse to the direction of package flow and delivering said web to said inverting head to be turned inside out and redirected into the path of package flow as packages pass through said inverting head and bear against a previously made transverse seal in said web;

a sealing area bounded on two sides by L-sealer jaws located adjacent the discharge end of said table and aligned with said path;

a discharge conveyor aligned with said path within said sealing area for receiving a package from said table, said discharge conveyor pivoted at its discharge end;

means for moving said discharge conveyor up and down at its input end to receive packages from said table at the height of said table and lower the enwrapped package to position the horizontal center line of the package at the height of the transverse seal jaws;

a fixed frame on which said base member is mounted for slidable motion transverse to the in-line direction of packages through the machine;

a package insertion assembly mounted on said frame, said assembly having transverse and longitudinal drive means;

an insertion arm mounted to be moved by said drive means; and control means for said drive means for sequentially transversely advancing said insertion arm after a package is deposited onto said table by said infeed conveyor, longitudinally driving said insertion arm to engage said package and advance it through the inverting head and onto the discharge conveyor, transversely withdrawing said insertion arm upon return longitudinal motion of said drive means to avoid contact with the next package deposited by said infeed conveyor, and starting said infeed conveyor during longitudinal motion of said insertion arm.

3. An automatic in-line L-sealer characterized by package transfer through the machine in a linear path at substantially uniform level comprising:

a substantially horizontal infeed conveyor aligned with said path;

drive means for intermittently operating said infeed conveyor; a base member;

a U-shaped inverting head mounted on said base with a longitudinal guide plate at the base of the U;

a substantially horizontal table mounted on said base member and aligned with said path for receiving a package deposited by said infeed conveyor, the surface level of said table being just below the discharge level of said infeed conveyor and extending through said U-shaped inverting head;

means for supplying a web of folded film transverse to the direction of package flow and delivering said web to said inverting head to be turned inside out and redirected into the path of package flow as packages pass over the surface of said table and through said inverting head and bear against a previously made transverse seal in said web;

a sealing area bounded on two sides by L-sealer sealing jaws located adjacent the discharge end of said table and aligned with said path;

a discharge conveyor aligned with said path within said sealing area for receiving a package from said table, said discharge conveyor pivoted at its discharge end;

means for moving said discharge conveyor up and down at its input end to receive packages from said table at the height of said table and lower the enwrapped package to position the horizontal center line of the package at the height of the transverse seal jaws;

a fixed frame on which said base member is mounted for slidable motion transverse to the in-line direction of packages through the machine;

a package insertion assembly mounted on said frame, said assembly having transverse and longitudinal drive means;

an insertion arm mounted to be moved by said drive means; and control means for sequentially stopping said infeed conveyor after a package is deposited on said table, transversely extending said insertion arm to position said package against said guide plate, longitudinally driving said insertion arm to insert said package by advancing it through the inverting head along said guide plate and onto said discharge conveyor, substantially simultaneously lowering said discharge conveyor and removing said insertion arm from the path of package flow, and starting said infeed conveyor during longitudinal motion of said insertion arm.

4. Apparatus according to claim 3 wherein said insertion arm is returned along a longitudinal path after being removed from the path of package flow.

5. Apparatus according to claim 4 wherein said table is an air table supplied with air pressure sufficient to support said package.

6. Apparatus according to claim 5 wherein said air table has greater surface hole density in the region adjacent said guide plate thereby to compensate for edge effect in supporting small packages.

7. An L-sealer comprising:

a package overwrapping station having a support for said package;

a sealing area for receiving said overwrapped package from said overwrapping station and supporting said overwrapped package below the level of said support;

L-shaped sealing jaws operable for sealing said overwrapped package in said sealing area;

said sealing area having a discharge conveyor for receiving and transporting said overwrapped package and supporting said overwrapped package during sealing, said discharge conveyor pivoted on a transverse axis at a fixed level at its discharge end;

means for raising and lowering the input end of said discharge conveyor to pivot about said axis to change the vertical position of said input end of said discharge conveyor between the level of said support and a lower level approximately half the vertical height of said package below said support; and drive means operable to run said discharge conveyor a predetermined time after forming a seal but before said input end is raised to said level of support.

8. Apparatus according to claim 7 and including control means for stopping said discharge conveyor upon receipt of an overwrapped package, lowering the inactive conveyor and package and operating said sealing jaws to seal said package when said conveyor is in its lowered position.

* * * * *

UNITED STATES PATENT AND TRADEMARK OFFICE

CERTIFICATE OF CORRECTION

PATENT NO. : 4,035,983

DATED : July 19, 1977

INVENTOR(S) : F.Garrett Shanklin, Edward F. Hunt and Francis X. King, Jr.

It is certified that error appears in the above-identified patent and that said Letters Patent are hereby corrected as shown below:

Column 3, line 40, "toque" should be -- torque --.

Column 4, line 19, "had" should be -- head --;
line 37, "3/80" should be -- 3/8 --.

Column 7, line 49, "24" should be -- 25 --;
line 55, "it" should be -- its --.

Signed and Sealed this

Fourteenth Day of February 1978

[SEAL]

*Attest:*

RUTH C. MASON
*Attesting Officer*

LUTRELLE F. PARKER
*Acting Commissioner of Patents and Trademarks*